US006374590B1

(12) United States Patent
Walch

(10) Patent No.: US 6,374,590 B1
(45) Date of Patent: Apr. 23, 2002

(54) LINK BRACELET FOR WATCHES OR THE LIKE

(76) Inventor: Christope Walch, St. Alban-Rheinweg 170, Basel (CH), CH-4052

( * ) Notice: Subject to any disclaimer, the term of this patent is extended or adjusted under 35 U.S.C. 154(b) by 0 days.

(21) Appl. No.: 09/600,383

(22) PCT Filed: Jan. 29, 1999

(86) PCT No.: PCT/CH99/00040

§ 371 Date: Oct. 16, 2000

§ 102(e) Date: Oct. 16, 2000

(87) PCT Pub. No.: WO99/38409

PCT Pub. Date: Aug. 5, 1999

(30) Foreign Application Priority Data

Jan. 30, 1998 (CH) ..... 221/98

(51) Int. Cl.[7] ..... F16G 15/04
(52) U.S. Cl. ..... 59/80; 63/4
(58) Field of Search ..... 59/80, 78, 84, 59/85; 63/4, 5

(56) References Cited

U.S. PATENT DOCUMENTS 1,792,996 A * 2/1931 Mason ..... 59/80
1,893,256 A * 1/1933 Wachenheimer ..... 59/80
2,460,654 A * 2/1949 Reinstein ..... 59/80
2,518,163 A * 8/1950 Megar ..... 59/80
3,609,963 A * 10/1971 Ichinose ..... 59/80
3,690,064 A * 9/1972 Pompeo ..... 59/35
3,726,083 A 4/1973 Pompeo

FOREIGN PATENT DOCUMENTS

CH 655 836 A5 5/1986
WO WO 89/12758 12/1989

* cited by examiner

*Primary Examiner*—David Jones
(74) *Attorney, Agent, or Firm*—Bryan Cave, LLP

(57) ABSTRACT

The invention concerns a link bracelet that can be assembled without any tools or special know-how. Said bracelet comprises external links with two parallel axles having a wedge-shaped cross section and central links with two parallel grooves for locating one of the axles of two adjacent external links. The groove has an oval cross section and an edge lying opposite to its opening and parallel to the axle. One of the two flat surfaces of the axle has a notch parallel to the axle. Said notch is flat in the direction of the outer side of the link and considerably slanted in the other direction where it forms a well-defined edge with the flat surface.

2 Claims, 2 Drawing Sheets

LINK BRACELET FOR WATCHES OR THE LIKE

The invention relates to a link bracelet which can be assembled from its links without any tools or special know-how, comprising external links made up of edge elements arranged at a distance from one another and joined together by two parallel axles, and central links with two parallel grooves for accommodating each of the axles of two adjacent external links, the external and central links alternating with one another in the assembled state.

Link bracelets of this type are known and are used particularly in cases where there is a need for an individual visual effect. Thus, for instance, links of different colours or shapes can be used to produce bracelets with attractive patterns which can be changed at any time the wearer desires.

In the known bracelets of this type, the axles are cylindrical in both their end regions, where they are joined to the edge elements, and substantially flat in the central region. In the central region corresponding to the flat region of the axles, the grooves in the central links have a width corresponding to the thickness of the flat region, and in their outer sections corresponding to the end region of the axles, they have a width corresponding to the diameter of the cylindrical end region. The entire groove widens inwards to said diameter in a cylindrical manner. For assembly, the axles of an external link can be inserted into the groove in a central link when the two links are at an angle of about 90° to each other, at right angles to the direction of the axle. To hold the axle in the groove, the cylindrical region of the axle is somewhat thicker than the width of the corresponding region of the groove so that the axle clicks into the groove on assembly. After straightening, the axle can no longer escape from the groove because the flat region is too wide.

A disadvantage of the known bracelets of this type is the fact that assembly, by simultaneously clicking the parts together at an angle, and also dismantling, by simultaneously pulling them apart at an angle, are extremely complicated. The object of the invention is to overcome this disadvantage.

This is achieved according to the invention in that the groove has an oval cross-section, in that the axles (3) have a substantially wedge-shaped cross-section with two flat surfaces (7) opposite one another and slanted towards one another, and in that one of the two flat surfaces of the axle has a notch parallel to the axle, which is flat in the direction of the outer side of the link and considerably slanted in the other direction, where it forms a well-defined edge with the flat surface.

In a preferred embodiment the groove has an edge opposite its opening and parallel to the axle. By virtue of these features of the invention, pressure no longer needs to be applied when the links are assembled; instead the axles click in automatically on twisting without the need to use additional pressure.

On dismantling, the effect of the oval shape is to push the axle out on twisting, i.e. no pulling is required.

Both functions are further improved in the preferred embodiment with the edge present in the groove.

An Example of the invention is described below with the aid of the attached drawings, in which.

Figure 1:
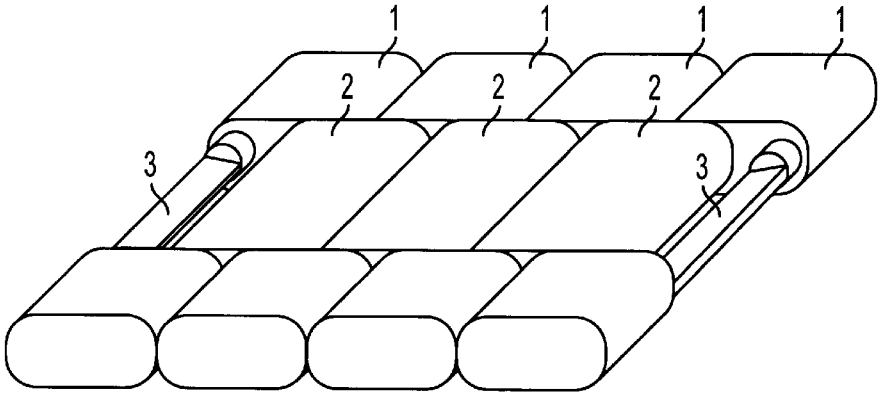
FIG. 1 shows a section of a link bracelet according to the invention.

The section of a link bracelet shown in FIG. 1 consists of four external links 1 and three central links 2, which join the external links together so that they can twist. Visible on both the external links at the ends of the section are axles 3 for connection to the next central links.

Figure 2:
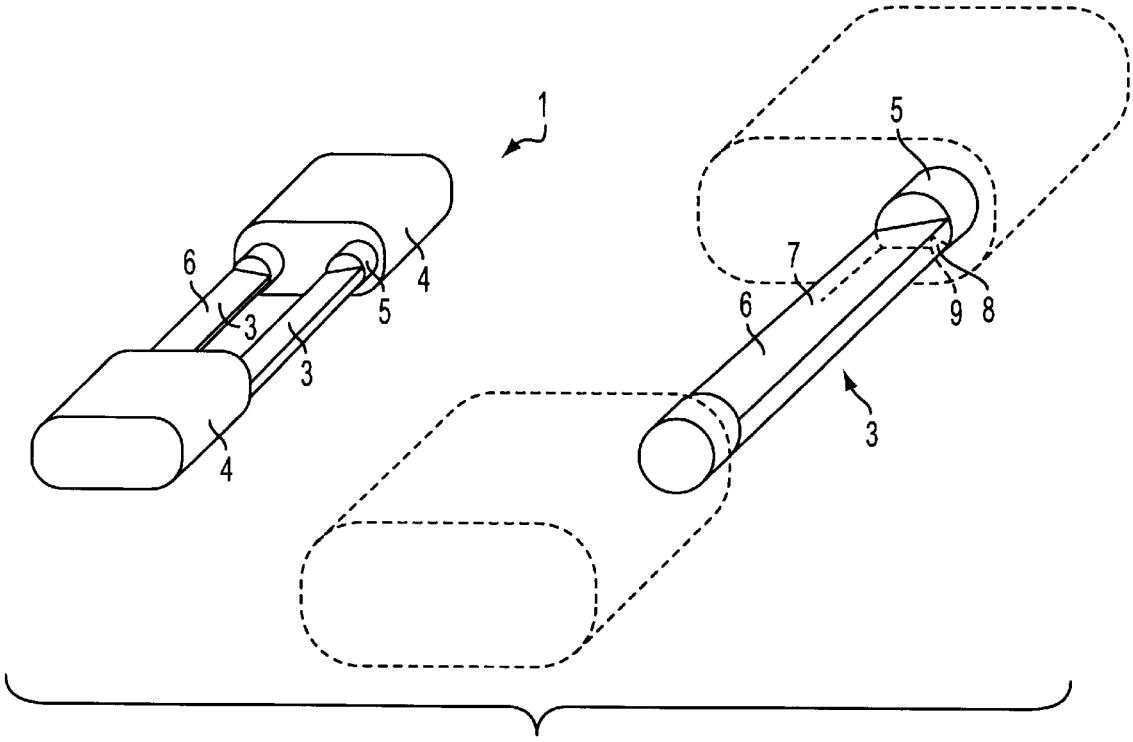
FIG. 2 shows an external link with an enlarged view of an axle.

The single external link 1 shown in FIG. 2 consists of two edge elements 4 joined together by two parallel axles 3. The shape of the edge elements 4 is principally determined by design considerations. The axles 3 are cylindrical in both their end regions 5, where they are joined to the edge elements 4. In their central region 6, their shape is substantially that of a flat prism with two flat prism surfaces 7 opposite one another, which are slanted towards one another to form a wedge-shaped cross-section. Like the end regions 5, the other two limiting surfaces of the central portions 6 of the axles, which join the flat surfaces together, are cylindrical.

Figure 4:
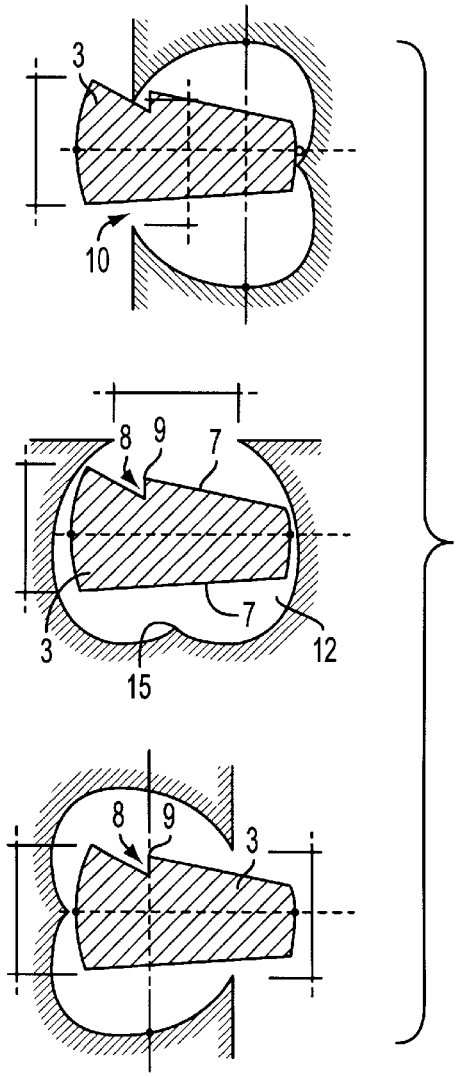
FIG. 4 shows different relative positions of the links in partial sections.

The enlarged detail b) of FIG. 2 shows a notch 8 in one of the two flat prism surfaces 7. This notch 8 runs parallel to the axle and is flat in the direction of the outer side of the link and considerably slanted in the other direction, where it forms a well-defined edge 9 with the flat surface 7. The shape of the notch 8 is also clearly visible in the sectional views of FIG. 4.

Figure 3:
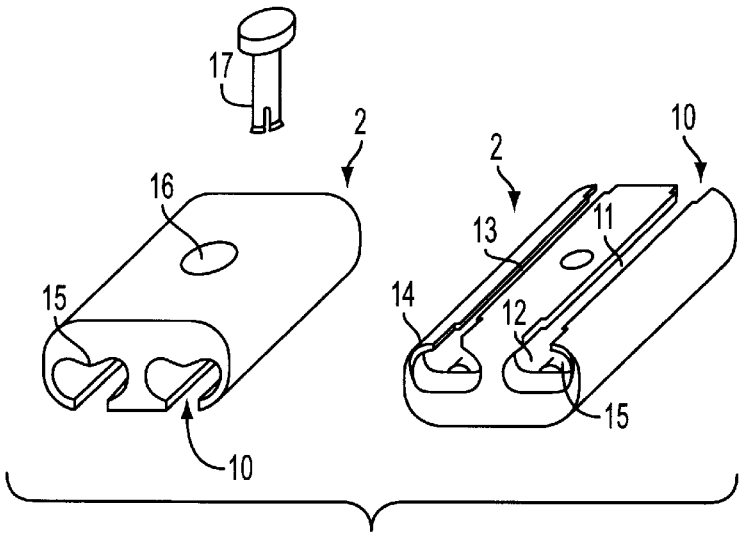
FIG. 3 shows two views of a central link.

The central link 2 shown in FIG. 3 has two parallel grooves 10 for accommodating each of the axles of two adjacent external links. The grooves 10 have an opening 11 and an interior space 12 which widens inwards, this interior space 12 having a substantially oval cross-section. The grooves 10 have a central region 13 corresponding to the central region 6 of the axles 3, and outer end regions 14 corresponding to the end regions 5 of the axles. In its central region 13, the groove has an edge 15 opposite its opening and parallel to the axle. In their central region 13, the openings 11 of the grooves 10 have a width corresponding to the thickness of the prismatic region, and in their end regions 14, they have a width corresponding to the diameter of the cylindrical end regions 5 of the axles 3.

As shown in FIGS. 1 and 3, the central links 2 have holes 16 for decorative elements 17.

As shown in FIG. 4*a*, two links are assembled by pushing the groove 10 of a central link over the axle 3 of an external link 1 from the narrower side of the axle, i.e. from the side between the two axles, the upper edge of the opening 11 of the groove clicking into the notch 8 in the axle. The central link is then twisted through approx. 90° (FIG. 4*b*), the edge 9 serving as an abutment for the edge of the opening 11 so that, on twisting, the axle also clicks in at the other edge of the opening. The position reached after twisting is the normal position of the links relative to each other.

The double clicking of the axle into the groove largely rules out the possibility of the two joined links being twisted back inadvertently. To separate the joined links, they are preferably twisted further in the other direction (FIG. 4*c*), this manipulation involving only one clicking operation between an edge of the axle and an edge of the opening. The narrow side of the axle 3 is thereby pushed into the opening of the groove 10 and can easily be removed.

What is claimed is:

1. A link bracelet comprising external links and central links connected together, wherein the external links comprise edge elements arranged at a distance from one another and joined together by two parallel axles, each axle having a substantially wedge-shaped cross section comprising a first and a second flat surface that are opposite to each other, and are slanted towards each other, and that run the length of each parallel axle, wherein there is a notch along an outer edge of the first flat surface of each parallel axle that runs the length of each parallel axle; and wherein the central links comprise two parallel grooves with a substantially oval cross section, each of the parallel grooves accommodating one of the parallel axles of an adjacent external link whereby the external and central links alternate with one another when connected.

2. A link bracelet according to claim 1, wherein each groove of the parallel grooves has an opening and located inside each groove and opposite each opening is a raised edge that is parallel to the opening.

* * * * *